United States Patent [19]

Kawano

[11] Patent Number: 4,589,317

[45] Date of Patent: May 20, 1986

[54] SHEET OR PLATE MATERIAL MACHINING EQUIPMENT

[75] Inventor: Susumu Kawano, La Habra, Calif.

[73] Assignee: U.S. Amada Limited, Buena Park, Calif.

[21] Appl. No.: 567,375

[22] Filed: Dec. 30, 1983

[51] Int. Cl.[4] ..... B26D 7/02

[52] U.S. Cl. ..... 83/400; 83/62; 83/409; 83/410; 83/552

[58] Field of Search ..... 83/62, 58, 399, 400, 83/409, 410, 412, 414, 415, 71, 277, 552, 466, 461; 269/23, 27–34, 61; 72/422, 24; 414/677

[56] References Cited

U.S. PATENT DOCUMENTS

| | | | |
|---|---|---|---|
| 3,027,792 | 4/1962 | Hohl | 269/32 X |
| 3,173,673 | 3/1965 | Northern et al. | 269/32 |
| 3,350,088 | 10/1967 | Schott | 83/412 X |
| 3,392,613 | 7/1968 | Johns | 83/412 X |
| 3,448,645 | 6/1969 | Graf et al. | 83/552 X |
| 3,456,536 | 7/1969 | Daniels | 83/62 |
| 3,603,187 | 9/1971 | Bredow | 83/62 |
| 3,717,061 | 2/1973 | Daniels | 83/409 |
| 4,297,927 | 11/1981 | Kuroda | 83/412 X |

*Primary Examiner*—James M. Meister
*Attorney, Agent, or Firm*—Wigman & Cohen

[57] ABSTRACT

A sheet or plate metal machining tool featuring a clamp for gripping the edge of the metal sheet and recognizing the said clamp is in a position to be struck by the tool's machining section. Upon such recognition, the clamp is capable of releasing the sheet and rotating out of the way of the machine tools.

7 Claims, 4 Drawing Figures

SHEET OR PLATE MATERIAL MACHINING EQUIPMENT

BACKGROUND OF THE INVENTION

1. Field of the Invention

This invention relates to sheet or plate metal machining equipment such as a turret punch press and laser beam machine which machine sheet or plate workpieces, and more specifically, to an improvement of a work clamp device to hold the edge or end of the workpiece in the sheet or plate material machining equipment.

2. Description of the Prior Art

As a sheet or plate material machining equipment which machines sheet or plate workpieces, the laser beam machine and turret punch press are known. In the laser beam machine, a workpiece is positioned relative to the machining area in X and Y axis directions when the work clamp device holding the edge of the workpiece, and/or a laser machining head is relatively moved. In the turret punch press, the workpiece is positioned relative to the machining area in the X and Y axis directions when the work clamp device is moved in the X and Y axis directions. In either case the work clamp device holding the edge of the workpiece may be machined when it enters the machining area of the sheet or plate material machining equipment.

Therefore, the conventional machines are generally equipped with a detector to detect the entry of the work clamp device into the machining area of the sheet or plate machining equipment so that the operation of the sheet or plate machining equipment is stopped when the detector operates. And when the operation of the sheet or plate machining equipment is stopped, it is necessary for the operator to manually remove the work clamp device from the machining area of the sheet or plate machining equipment. Therefore, once the sheet or plate machining equipment is stopped, it takes a long time before it is restarted.

SUMMARY OF THE INVENTION

The primary object of this invention is to provide a sheet or plate material machining machine in which the work clamp device can retreat automatically from the machining area of the sheet or plate material machining equipment when the work clamp device is entering the machining area.

Another object of this invention is to provide an efficient sheet or plate material machining machine in which the work clamp device will not enter the machining area of the sheet or plate material machining equipment.

In order to achieve the above objects, the metal plate material machining equipment of this invention is equipped with means to detect the entry of the work clamp device into the machining area and so designed that the work clamp device can automatically retreat from the machining area when the said detecting means operates.

Other and further objects and advantages of the present invention will be apparent from the following description and accompanying drawings which, by way of illustration, show a preferred embodiment of the present invention and the principle thereof.

DESCRIPTION OF THE PREFERRED EMBODIMENT

Figure 1:
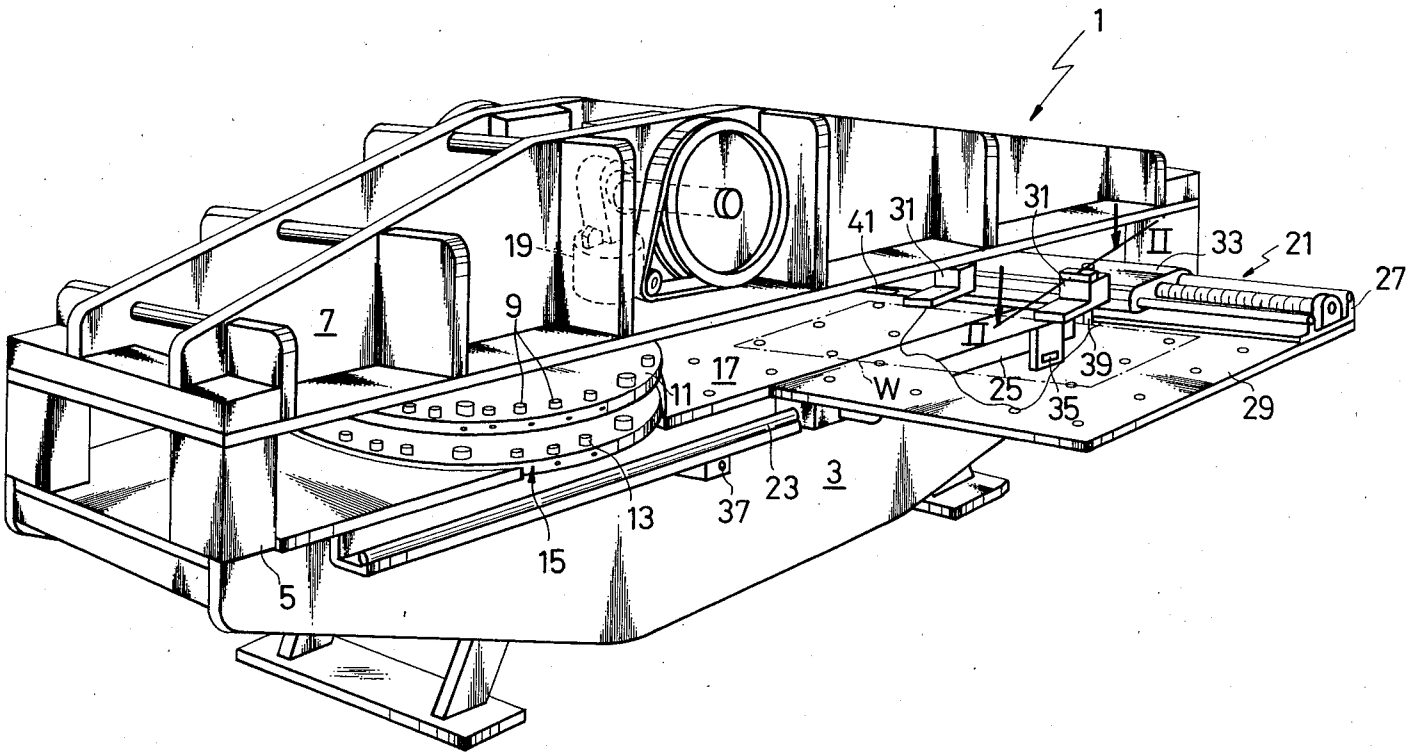
FIG. 1 is a partially broken away perspective view of a turret punch press used as sheet or plate material machining equipment.

Referring to the drawings, FIG. 1 shows a turret punch press 1 as one example of the sheet or plate material machining equipment which machines a sheet or plate workpiece W. This turret punch press 1 has a lower frame 3 and an upper frame 7 provided above the lower frame 3 with a plurality of struts therebetween. Under the upper frame 7, an upper turret 11 bearing various punches 9 is rotatably installed, and on the lower frame 3 a lower turret 15 bearing dies 13 corresponding to the punches 9 is rotatably installed and opposed to the upper turret 11, and also a fixed table 17 to bear the workpiece W is installed. In order to strike the punches 9 a striker 19 which freely moves up and down is installed on the upper frame 7.

In the above structure, the workpiece W is punched in such a manner that the striker 19 strikes the punch 9 after a proper punch 9 and die 13 are indexed under the striker 19 with the workpiece properly positioned between the upper turret 11 and lower turret 15. In the turret punch press 1, the machining section exists under the striker 19 and the adjacent surrounding area of the machining section is a danger area.

In order to position the workpiece W relative to the above machining section, a moving and positioning device 21 is provided in the turret punch press 1. On both sides of the upper part of the lower frame 3, Y-axis guide rails 23 extending in the Y-axis direction are provided, and on the Y-axis guide rails 23 a first carriage 27 and movable table 29 to support the workpiece W are installed via sliders 25 in a freely moving way. The first carriage 27 is extended in the X-axis direction which crosses the Y-axis guide rail 23 at a right angle, and it bears a second carriage 33, movable in the X-axis direction, which bears a plurality of work clamp devices 31 in a position-adjustable way. The work clamp devices are to hold the edge of the workpiece W.

Therefore, the workpiece W held by the plurality of work clamp devices 31 can be moved properly in the X-axis and Y-axis directions and positioned properly relative to the aforementioned machining section, when the first carriage 27 is properly moved in the Y-axis direction and the second carriage 33 is properly moved in the X-axis direction.

In order to detect the entry of the work clamp device 31 into the danger area of the machining section under the striker 19, a Y-axis dog 35 is installed in a proper position of the slider 25 and a Y-axis detector 37 such as a limit switch is provided in a proper position on the lower frame 3. On both sides of each work clamp device 31 in the X-axis direction, an X-axis detector 39 such as a limit switch is installed, respectively, and in the position where the first carriage 27 corresponds to the danger area, an X-axis dog 41 to operate the X-axis detector 39 is installed.

In the above structure, if the Y-axis detector 27 is operated by the Y-axis dog 35 when the first carriage 27 moves in the Y-axis direction, it is detected in the Y-axis direction that the work clamp 31 is positioned in the danger area. Similarly, when the X-axis detector 39 is operated by the X-axis dog 41 when the second carriage 33 moves in the X-axis direction, it is detected in the X-axis direction that the work clamp 31 is positioned in the danger area. Therefore, when both the Y-axis detector 37 and X-axis detector 39 are operated, it can be understood that the entry of the work clamp device 31 into the danger area is detected.

Figure 2:
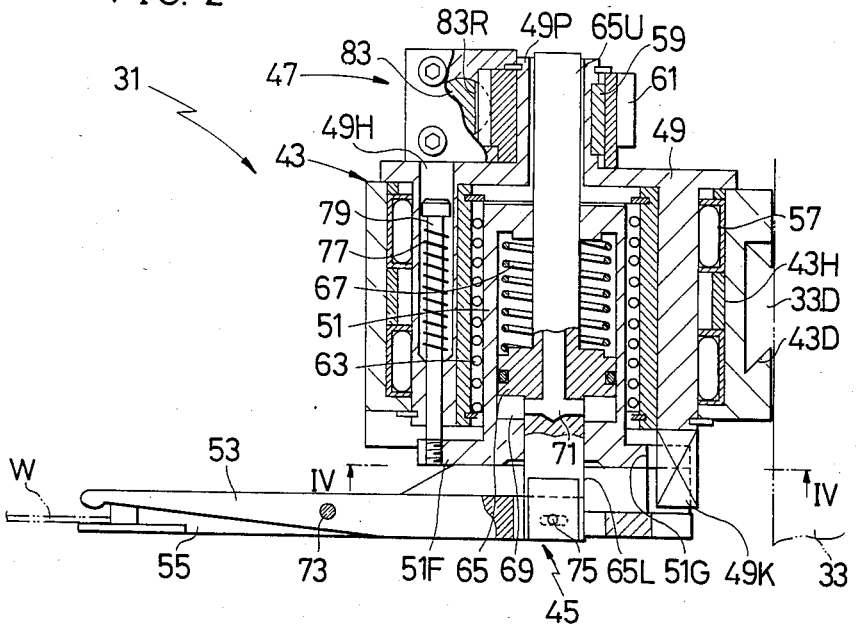
FIG. 2 is an enlarged view taken along the line II—II of FIG. 1.
Figure 3:
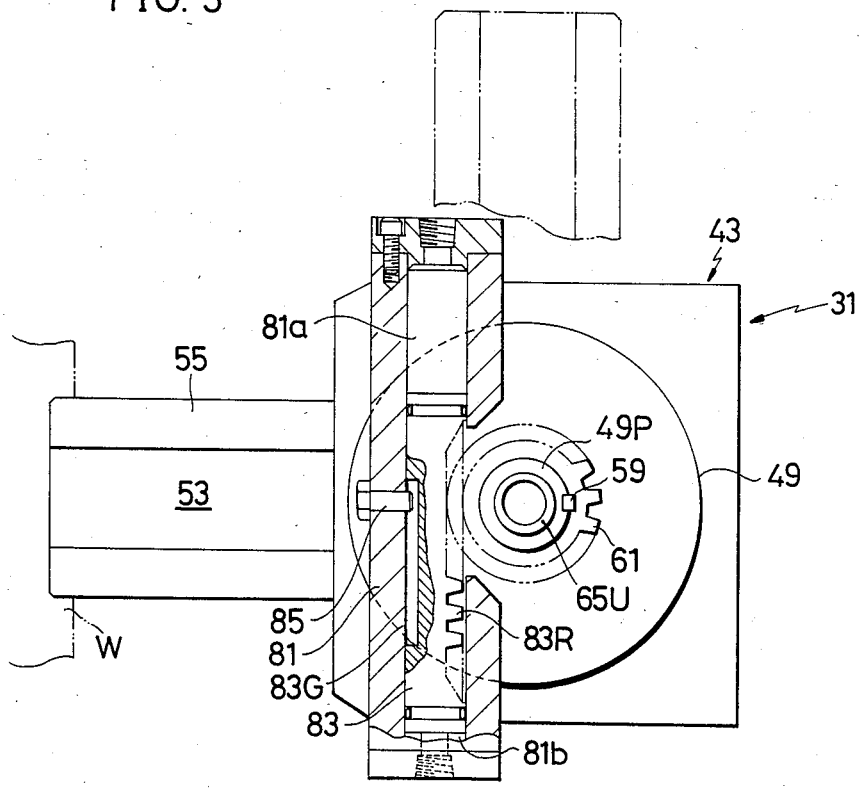
FIG. 3 is a plan view, partially broken away, of the portion shown in FIG. 2.
Figure 4:
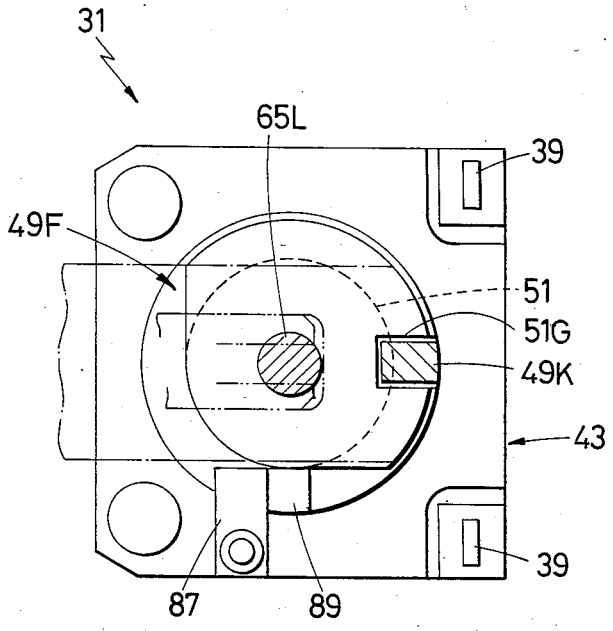
FIG. 4 is a sectional view taken along the line IV—IV of the FIG. 2.

Referring to FIGS. 2–4, the work clamp device 31 consists of a clamp body 43 supported by the second carriage 33, a clamp operating part 45 supported rotatably and vertically movably by the clamp body 43, and a drive means 47 to turn the clamp operating part 45.

The clamp body 43 is almost cubic in this embodiment, and on one side thereof a dovetail groove 43D is formed to receive a dovetail 33D formed on the second carriage 33. Via this dovetail groove 43D the clamp body 43 is supported in a normal way and in a position-adjustable way by the second carriage 33. In the center of the above clamp body 43, a big through hole 43H is formed, on both sides in the X-axis direction of the lower surface, as shown in FIG. 4, the aforementioned X-axis detectors 39 are provided.

As clearly shown in FIG. 2, the aforementioned clamp operating device 45 consists of a turning cylinder 49 rotatably supported in the through hole 43H of the clamp body 43, a cylinder 51 vertically movably supported in the turning cylinder 49 and upper and lower clamp jaws 53 and 55 which grip the workpiece W.

The above turning cylinder 49 forms a cylinder opened wide downward and is rotatably supported in the through hole 43H of the clamp body 43 via bearing 57, and to the cylindrical projection 49P extending upward from the center of the upper part of the cylinder 49, a pinion 61 is integrally installed via a key 59. In the turning cylinder 49, the aforementioned cylinder 51 is inserted vertically movably via the stroke bearing 63 from the downside. In a flange 51F formed at the lower part of this cylinder 51 a keyway 51G is formed and in this keyway 51G a key 49K projecting downward from the aforementioned turning cylinder 49 is engaged. That is, the turning of the cylinder 51 relative to the turning cylinder 49 is prevented.

In the above cylinder 51, a piston 65 with its lower piston rod 65L projecting downward and its upper piston rod 65U projecting upward is slidably installed, and between this piston 65 and cylinder 51, a spring 67 for biasing down the piston 65 is installed. In order to operate the piston 65 against the spring 67, the upper piston rod 65U is provided with a working fluid passage 71 connected into an operating chamber 69. Under the aforementioned cylinder 51 the aforementioned lower clamp jaw 55 is integrally installed, and on this lower clamp jaw 55 the upper clamp jaw 53 is pivotally mounted via a pin 73. And the base of the upper clamp jaw 53 and the lower piston rod 65L are pivotally connected to each other via a connecting pin 75.

In the above structure the workpiece W is gripped by the upper and lower clamp jaws 53 and 55 when the working fluid is supplied from the working fluid passage 71 into the operating chamber 69 of the cylinder 51, and the workpiece W is released by the upper and lower clamp jaws 53 and 55 by the action of the spring 67 when the working fluid is discharged from the operating chamber 69.

In order to provide smooth vertical movement of the aforementioned cylinder 51 and the upper and lower clamp jaws 53 and 55 even if the lower clamp jaw 55 rides on the aforementioned die 13, a balance spring 77 is provided. That is, in a hole 49H vertically provided in the turning cylinder 49, a rod 79 with its lower end threadably attached to the flange 51F of the cylinder 51 is fitted in a vertically movable way, and between the head of this rod 79 and the bottom of the hole 49H the balance spring 77 is resiliently installed. This balance spring 77 is to bear the weight of the cylinder 51 and the upper and lower clamp jaws 53 and 55. Therefore, the vertical movement of the cylinder, etc. can be very smoothly made.

The aforementioned drive means 47 has a spool 83 slidably installed in a cylinder 81 installed horizontally on the top side of the aforementioned clamp body 43. In this spool 83 a rack 83R meshed with the aforementioned pinion 61 and the longitudinal keyway 83G are formed, and in the keyway 83G the end of the bolt 85 screwed in the cylinder 81 is engaged, thus its rotation is prevented. The above spool 83 reciprocates when the working fluid is supplied alternately into the operating chambers **81*a* and 81*b* located on both sides of the cylinder 81**.

In the above structure, when the pinion 61 is turned by the operation of the drive means 47, both upper and lower clamp jaws 53 and 55 are turned from the solid line position to the phantom line position or reversely as shown in FIG. 3 via the turning cylinder 49.

In order to maintain accurately the stopping positions of the above turning cylinder 49 and the upper and lower clamp jaws 53 and 55, a stopper 87 is provided on the under side of the clamp body 43, and under the turning cylinder 49, and abutting member 89 which abuts to the stopper 87 is provided and also an abutting surface 49F is formed, as shown in FIG. 4. Therefore, even if the upper and lower clamp jaws 53 and 55 are turned horizontally, the stopping position is always kept accurate.

As understood from the above explanation, when both the aformentioned Y-axis detector 37 and X-axis detector 39 are operated, both the upper and lower clamp jaws 53 and 55 retreat from the danger area of the machining section is such a way that the workpiece W is released by the work clamp device 31 entering the danger area of the machining section and then the upper and lower clamp jaws 53 and 55 are turned to the phantom line position shown in FIG. 3 by the operation of the drive means 47 of the work clamp device 31, thus eliminating the possibility of the upper and lower clamp jaws 53, 55 entering the danger area and being machined at the machining section.

The turret punch press is usually controlled by means of the numerically controlling device, and if the aforementioned various operations are automatically controlled, the work clamp devices can be automatically removed when they are entering the danger area of the machining section and workpieces can be continuously machined without stopping the machining equipment, thus increasing the work efficiency.

Although a preferred from of the present invention has been illustrated and described, it should be understood that the device is capable of modification by one skilled in the art without departing from the principles of the invention. Accordingly, the scope of the invention is to be limited only by the claim appended hereto.

I claim:

1. Apparatus for machining sheet material, comprising:

operating tools for machining a sheet material;

a work table movable along a first axis for moving the sheet material with respect to said operating tools;

carriage means mounted on said work table and movable along a second axis perpendicular to said first axis;

work clamp means mounted on said carriage for holding and positioning the sheet material;

upper and lower jaws extending horizontally from said work clamp means for clamping the sheet material therebetween;

first detector means mounted at a predetermined position along said first axis with respect to said operating tools;

first actuating means carried by said movable table for actuating said first detector means when moved along said first axis into proximity therewith;

second detector means mounted at a predetermined position along said second axis with respect to said operating tools;

second actuating means carried by said carriage means for actuating said second detector means when moved along said second axis into proximity therewith;

said first and second detector means being positioned with respect to one another along said respective first and second axis as to define a danger zone in the vicinity of said operating tools when said axes intersect at a predetermined point; and means for releasing said upper and lower jaws from clamping engagement with the sheet material and for rotatably retracting said jaws out of said danger zone in response to the simultaneous actuation of both said first and second detector means.

2. The apparatus according to claim 1, further comprising hydraulic means for activating the work clamp means to clamp and release the sheet material.

3. The apparatus according to claim 2, wherein the hydraulic means comprises a spring biased piston connected to the work clamp means, the piston being biased in a position releasing the sheet material.

4. The apparatus according to claim 1, wherein the releasing means comprises a spring biased hydraulic piston connected to one end of the work clamp means.

5. The apparatus according to claim 4, further comprising a spring mounted with respect to the piston for biasing the work clamp means in a released position.

6. The apparatus according to claim 5, further comprising a chamber adjacent the piston into which fluid can be forced in order to apply a clamping force to the work clamp means.

7. The apparatus according to claim 1, wherein the means for rotatably retracting said jaws comprises:

a spool slidably installed along the work clamp means;

a rack arranged on the spool;

a pinion meshing with the rack; and means interconnecting the pinion to the jaws so that when the spool is slid along the work clamp means, the rack rotates the pinion which rotates the jaws via the interconnecting means.

* * * * *